US011554903B2

(12) United States Patent
Brandt

(10) Patent No.: US 11,554,903 B2
(45) Date of Patent: Jan. 17, 2023

(54) CONTAINER LID AND LOCK RING COMBINATION

(71) Applicant: Container International, Inc., Palatine, IL (US)

(72) Inventor: Richard P. Brandt, Crystal Lake, IL (US)

(73) Assignee: CONTAINER INTERNATIONAL, INC., Palatine, IL (US)

( * ) Notice: Subject to any disclaimer, the term of this patent is extended or adjusted under 35 U.S.C. 154(b) by 587 days.

(21) Appl. No.: 16/559,579

(22) Filed: Sep. 3, 2019

(65) Prior Publication Data

US 2020/0071039 A1 Mar. 5, 2020

Related U.S. Application Data

(60) Provisional application No. 62/726,362, filed on Sep. 3, 2018.

(51) Int. Cl.
*B65D 45/34* (2006.01)

(52) U.S. Cl.
CPC .. *B65D 45/345* (2013.01); *B65D 2543/00092* (2013.01); *B65D 2543/00296* (2013.01); *B65D 2543/00685* (2013.01)

(58) Field of Classification Search
CPC ..... B65D 45/345; B65D 2543/00296; B65D 45/34
USPC ..... 220/319, 320, 321
See application file for complete search history.

(56) References Cited

U.S. PATENT DOCUMENTS

| | | | | |
|---|---|---|---|---|
| 620,623 | A | 3/1899 | Weissenthanner | |
| 625,573 | A | 5/1899 | Leavitt | |
| 643,908 | A | 2/1900 | Meyer | |
| 815,558 | A | 3/1906 | Rosier | |
| 857,197 | A | 6/1907 | Patterson | |
| 1,681,150 | A | 8/1928 | Vischer, Jr. | |
| 2,011,044 | A | 8/1935 | Fetter | |
| 2,075,381 | A | 3/1937 | Gar | |
| 2,081,877 | A | 5/1937 | Shanor | |
| 2,108,024 | A | 2/1938 | Shanor | |
| 2,176,310 | A * | 10/1939 | Newton | B65D 45/345 292/256.69 |
| 2,194,162 | A | 3/1940 | Conner | |
| 2,213,163 | A | 8/1940 | Gustafson | |
| 2,236,302 | A | 3/1941 | Scott | |
| 2,265,167 | A | 12/1941 | Hothersall | |
| 2,289,422 | A | 7/1942 | Grotnes | |
| 2,303,625 | A | 12/1942 | Denbigh | |
| 2,304,911 | A | 12/1942 | Harpold | |
| 2,593,971 | A | 4/1952 | Brandt | |
| 2,683,051 | A | 7/1954 | Christophersen | |
| 2,773,709 | A | 12/1956 | Douglas | |

(Continued)

FOREIGN PATENT DOCUMENTS

| | | | |
|---|---|---|---|
| BE | 1009404 | A3 | 3/1997 |
| EP | 0054171 | A1 | 6/1982 |
| IN | 681MUM2006 | | 4/2008 |

*Primary Examiner* — Jeffrey R Allen
(74) *Attorney, Agent, or Firm* — Lempia Summerfield Katz LLC

(57) ABSTRACT

A container lid and lock ring combination includes a lid for a container and a lock ring configured to extend loosely around the lid. The lock ring is configured to be tightened for securing the lid to a container. A joint connects the lid and the lock ring to one another.

14 Claims, 8 Drawing Sheets

(56) References Cited

U.S. PATENT DOCUMENTS

| | | | | |
|---|---|---|---|---|
| 3,028,993 | A | 4/1962 | Friedrich | |
| 3,070,397 | A | 12/1962 | John | |
| 3,091,489 | A | 5/1963 | Vaughn | |
| 3,633,956 | A | 1/1972 | Angell | |
| 3,770,157 | A | 11/1973 | Setele | |
| 3,795,028 | A | 3/1974 | Weiss | |
| 3,940,004 | A | 2/1976 | Faulstich | |
| 4,314,720 | A | 2/1982 | Santoni | |
| 4,377,245 | A | 3/1983 | Patty | |
| 4,382,570 | A | 5/1983 | Craig | |
| 4,611,478 | A | 9/1986 | Carlson et al. | |
| 4,718,571 | A | 1/1988 | Bordner | |
| 5,020,839 | A | 6/1991 | Kalb | |
| 5,129,537 | A | 7/1992 | Bordner et al. | |
| 5,219,088 | A | 6/1993 | Reina | |
| 5,295,604 | A | 3/1994 | Van | |
| 5,713,482 | A | 2/1998 | Bordner et al. | |
| 5,785,201 | A | 7/1998 | Bordner et al. | |
| 5,947,320 | A | 9/1999 | Bordner et al. | |
| 6,126,213 | A | 10/2000 | Jones et al. | |
| 7,243,962 | B2 | 7/2007 | Stolzman | |
| 8,540,102 | B2 | 9/2013 | Taylor | |
| 8,985,647 | B2 | 3/2015 | Kuzelka | |
| 9,027,775 | B2 | 5/2015 | Brandt | |
| 2006/0097524 | A1 | 5/2006 | Stolzman | |
| 2006/0220395 | A1 | 10/2006 | Kuzelka | |
| 2007/0102941 | A1 | 5/2007 | Easterday et al. | |
| 2008/0079265 | A1 | 4/2008 | Baughman et al. | |
| 2009/0152271 | A1 | 6/2009 | Kuzelka | |
| 2009/0294449 | A1 | 12/2009 | Taylor | |
| 2014/0049057 | A1 | 2/2014 | Brandt | |
| 2014/0054905 | A1 | 2/2014 | Brandt | |
| 2015/0014318 | A1* | 1/2015 | Taylor | B65D 21/022 220/321 |

* cited by examiner

CONTAINER LID AND LOCK RING COMBINATION

RELATED APPLICATION DATA

This patent is entitled to the benefit of and claims priority to U.S. Provisional Application Ser. No. 62/726,362 filed Sep. 3, 2018 and entitled "Container Lid and Lock Ring Combination." The entire contents of this prior filed application are hereby incorporated herein by reference.

BACKGROUND OF THE INVENTION

1. Field of the Disclosure

The present disclosure is generally directed to storage container lids and lock rings, and more particularly to a lock ring and lid combination for storage containers.

2. Description of Related Art

Cylindrical containers of different sizes are known in the art for holding and storing many different types of materials. Such materials include solids, which may be pellets, granules, grains, particles, and the like. Such materials also include liquids, which may be chemicals, oils, paints, industrial materials, and the like. These types of containers come in a range of different shapes and sizes, including large fifty-five-gallon drums and small five-gallon buckets. These types of containers are sometimes constructed of a metal material such as steel. These types of containers are sometimes constructed of a fiber material and have a metal chime around the top and a steel closure at the bottom. These types of containers are also sometimes constructed of a molded plastic material.

Material storage containers of this type include a removable lid, which is used to close off the open top of the container. The lids are typically formed from stamped metal or molded plastic. The lids are then secured onto the drums by a ring clamp or lock ring. Such clamps or lock rings have a channel to capture a rim of the lid-to-container interface. An over-center lever is generally used to draw the ends of the ring clamp or lock ring structure together. The lock ring thus secures the lid in place on the container.

The lids and lock rings are typically manufactured, transported, stored, and installed as separate items to be installed on the containers. Thus, the lids and lock rings require two skews for transport, distribution, and tracking purposes. The lids and lock rings also require two separate storage areas in a facility where the containers are filled and where the lids and lock rings are installed to seal the containers. The lids and lock rings also require separate handling by personnel within these facilities, such as the personnel installing the lids and the personnel installing and securing the lock rings in place.

The number of different parts can add complexity and increase the cost of the manufacturing and filling processes. These issues can also result in either the lids or the lock rings being incorrectly selected and mated for a given container, if more than one size or type of container, lid, and/or lock ring is being handled within the same facility. Such errors can create downstream problems with leakage or unintentional lock ring or lid removal or detachment during shipping or handling.

SUMMARY

In one example according to the teachings of the present disclosure, a container lid and lock ring combination has a lid for a container and a lock ring configured to extend loosely around the lid. The lock ring is configured to be tightened for securing the lid to a container. A joint connects the lid and the lock ring to one another.

In one example, the lid can be formed of a plastic material.

In one example, a body of the lock ring can be formed of a plastic material.

In one example, the joint can include a strap on one of the lid and the lock ring and can include a stand-off on the other of the lid and the lock ring. A free end of the strap can be configured to be received through an aperture of the stand-off.

In one example, a prong can be provided on a free end of a strap of the joint. The prong can be configured to be forcibly received one way through an aperture but to prevent or inhibit being reversed the other way through the aperture.

In one example, a strap of the joint can be on one end of the lock ring body and a stand-off of the joint can be on a rim of the lid.

In one example, a strap of the joint can be formed integrally as a part of the lock ring body.

In one example, a stand-off of the joint can be formed integrally as a part of the lid rim.

In one example, a strap of the joint can be on one end of a lever coupled to one end of the lock ring body.

In one example, a strap of the joint can be received through a slot in one end of the lock ring body and then through an aperture of a stand-off of the joint.

In one example according to the teachings of the present disclosure, a container assembly has a container with a top opening, a lid for closing off the top opening of the container, a lock ring configured to extend loosely around the lid in an open or unlocked condition and to be tightened for securing the lid to a container, and a joint connecting the lid and the lock ring to one another to form a lid and lock ring combination.

BRIEF DESCRIPTION OF THE DRAWINGS

Objects, features, and advantages of the present disclosure will become apparent to these having ordinary skill in the art upon reading the following description in conjunction with the drawing figures.

FIG. 3 shows a perspective view of one example of a lid and lock ring combination in accordance with the teachings of the present disclosure and in a partly open or unlocked condition and.

DETAILED DESCRIPTION OF THE DISCLOSURE

The disclosed lid and lock ring combination solves or improves upon one or more of the above-noted and/or other problems and disadvantages with prior known container assemblies, lids, and lock rings. The disclosed lid and lock ring combination can be used for various container sizes and lid and lock ring styles. The combination is not limited to a particular lock ring or lid configuration. The disclosed lid and lock ring combination joins a lock ring to a lid for which it is intended to be used. The joined lid and lock ring parts together form the disclosed combination. In the combined or joined arrangement, the lid and lock ring can be transported, distributed, stored, and installed as one part. The disclosed lid and lock ring combination can also be identified as a single skew number for tracking purposes during shipping, storage, and installation at a facility. These and other objects, features, and advantages of the disclosed lid and lock ring combination may become apparent upon reading this disclosure.

Figure 1:
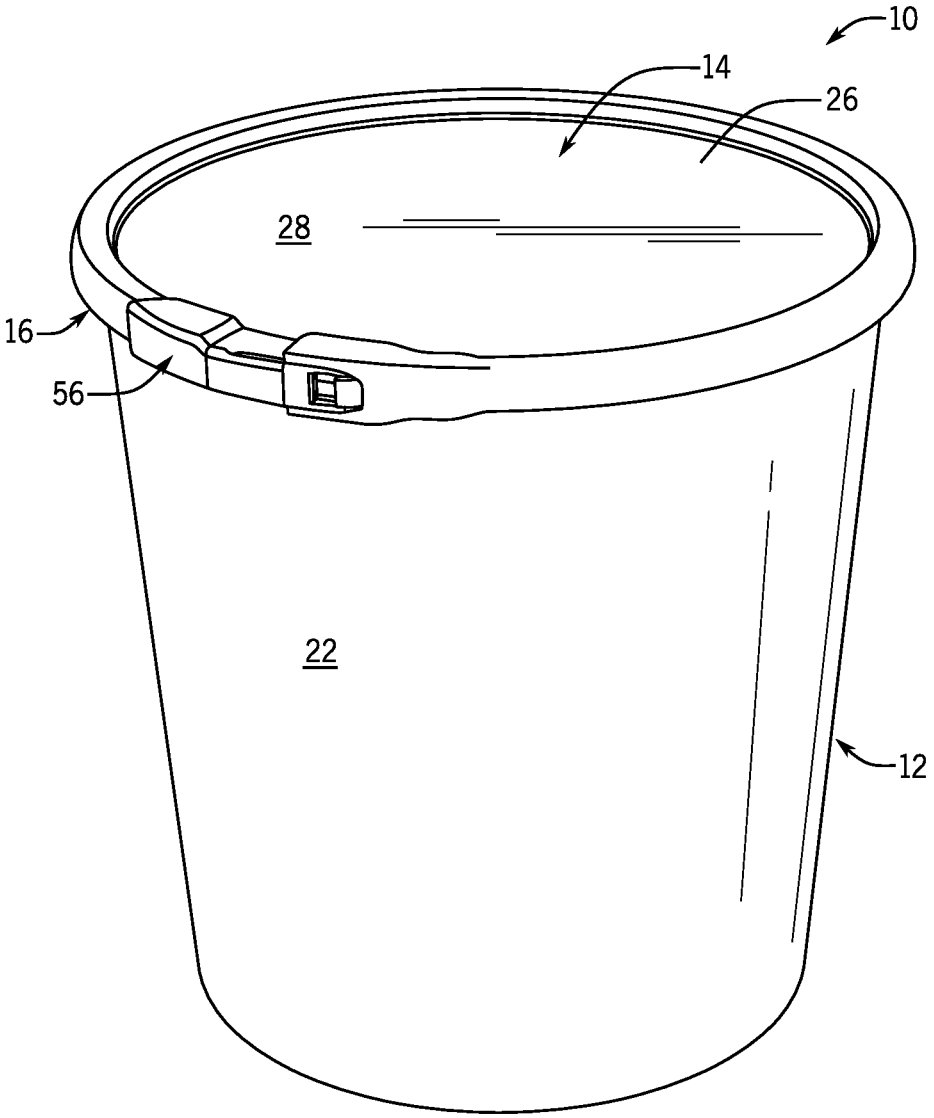
FIG. 1 shows one example of a container assembly including a generic container, lid, and lock ring in accordance with the teachings of the present disclosure.

Turning now to the drawings, FIG. 1 shows one example of a container assembly 10 of a type in accordance with the teachings of the present disclosure. The container assembly 10 is depicted in a generic form in the drawings. In this example, the container assembly 10 has a container 12, a lid 14 closing a top opening of the container, and a lock ring 16 securing the lid to the container. FIG. 1 shows a perspective view of the container assembly 10 and illustrates the lock ring 16 closed or clamped around the perimeter of the lid 14 and the top opening of the container 12 to secure the lid in place. The lid 14 and lock ring 16 in FIG. 1 may be generic, existing components or may be a lid and lock ring combination constructed in accordance with the teachings of the present disclosure.

Figure 2B:
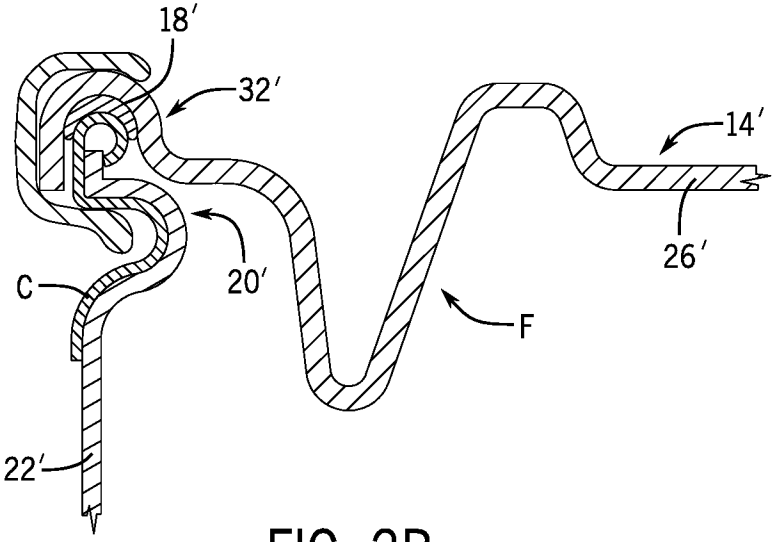
FIGS. 2A and 2B show cross-section views of just two of many different possible alternate container lip, lid rim, lid, and lock ring constructions that are possible for use with the teachings of the present disclosure.
Figure 2A:
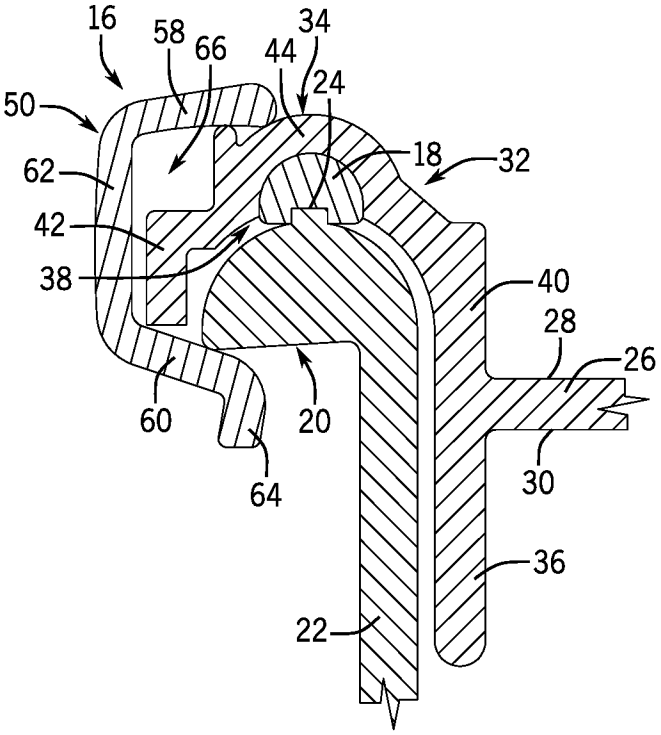

FIGS. 2A and 2B show just two different examples in cross-section of many possible variations and constructions of both the lid 14 and the lock ring 16. The lid 14 and lock ring 16 can each vary in size, shape, contour, features, and the like within the scope of the present disclosure. As shown in FIG. 2A, a seal 18 may be provided between a lid 14 and a lip 20 of a container 12 to which the lid is attached. The seal 18 or 18, if provided, may have a structure that can also vary within the scope of the present disclosure. As depicted in FIGS. 2A and 2B, the shape of the container lip 20 or 20' at the top of a side wall 22 or 22' to which the lid 14 or 14' and the lock ring 16 or 16' attach can also vary in size, shape, contour, and features. In other words, the lid 14 and the lock ring 16 can be constructed to accommodate the particulars of the container 12 and lip 20 configurations. FIG. 2A shows a generic lid 14 and container 12 attachment structure. FIG. 2B shows a different version with a metal chine C as a part of the container lip 20'. Details of the alternate structure of FIG. 2B are not described in detail herein. However, some details, features, and aspects of the components and features depicted in FIG. 2A, as described below, may pertain equally to the structure of FIG. 2B.

Referring to FIGS. 1 and 2A, the container 10 in this example can be a conventional plastic bucket, such as a five-gallon bucket. The container 10 has a closed bottom (not shown) and a somewhat cylindrical, though vertically tapered, side wall 22 extending up from the closed bottom. The side wall 22 terminates at a top edge 24, which surrounds and can define the top opening of the container 12. The lip 20 can be an annular lip that protrudes radially outward from the side wall 22 at the top edge 24. The lip 20 and top edge 24 may be described as defining or forming an upper rim of the container 12.

The container 12 and lid 14 may each be constructed in many different shapes, sizes, and forms without departing from the scope of the present disclosure. As noted above, the material from which the container is made can also vary. The container may be molded as a one-piece plastic structure, as in the present example. Instead, the container can be formed of multiple steel components that are welded together or otherwise suitably assembled. The container can instead be made having a fiber material side wall with an attached steel bottom, a steel chime around the top opening (see the chine C in FIG. 2B), and a steel chime around the bottom, if desired. The shape and configuration of the upper rim, including the top edge 24 and the lip 20, can also vary from the example described herein and yet perform as intended. The lock ring lid 14 can be designed to accommodate different sized and shaped upper rim and lid features on the container. The lid can also be formed of any suitable material.

Referring to FIGS. 1 and 2A, the lid 14 in one example has a top panel 26 that is generally disc shaped and sized to cover the top opening of the container 12. The top panel may have contoured, non-flat features (see the feature F in FIG. 2B) on the top panel, which may extend circumferentially around the lid 14. In this example, the top panel 26 has a top side 28 defining an upper surface of the lid 14 and an underside 30 defining a lower surface of the lid. The lid 14 has a lid rim 32 that extends around and is connected to a perimeter of the top panel 26 and in turn defines the outer periphery of the lid. In one example, the lid rim 32 has a channel section 34, defined by a wall, and that is contoured upward in the direction of the top side 28 and radially outward relative to the adjacent perimeter of the top panel 26. The lid rim 32 also has an annular flange section 36 extending downward in the direction of the underside 30 of the top panel 26 from the adjacent perimeter of the top panel. The flange section 36 is a downward continuation of a portion of the wall W of the channel section 34.

In one example, the channel section 34 is contoured in cross-section. The wall of the channel section 34 is a continuously curved U shape, which is concave in the direction of the underside 30 of the top panel 26 and convex in the direction of the top side 28. A channel 38 is defined on the concave underside of the wall. The upper rim, i.e., the top edge 24 and lip 20 of the container 12, can be configured having a shape that corresponds with and fits within the shape of the channel 38. Thus, the upper rim of the container can seat within the channel of the lid rim.

The wall W of the channel section 34 on the lid rim has an inverted U shape in cross-section. The lid rim has an annular inner wall portion 40 that extends around the top panel 26 and protrudes upward from the perimeter of the top panel. The annular flange section 36 is a continuation of the inner wall portion 40 below the top panel. The lid rim also has an annular outer wall portion 42 that extends around the lid rim and that is spaced radially outward relative to the inner wall portion 40. In this example, the inner and outer wall portions 40, 42 are connected to one another at their respective upper ends by a shoulder portion 44 of the wall that bridges the space between the wall portions. The wall is elevated relative to the adjacent portion of the top panel in one example. The channel section 34 of the lid rim, i.e., the wall, inclusive of the inner and outer wall portions 40 and 42 and the shoulder portion 44, combine to define the upwardly closed channel 38 under the lid rim between the inner and outer wall portions. When the lid 14 is attached to the container, as shown in FIG. 2A, to close off the top opening, the top edge 24 of the container rim seats in the channel 38. If provided, the seal 18 is sandwiched between the top edge 24 and the surfaces of the channel 38. The seal 18 may be a separate component or may be provided as a part of the container 12 or the lid 14.

The lock ring 16 is used to secure the lid 14 onto the container 12. The configuration and construction of the lock ring 16 can also vary considerably and yet function as intended. Thus, the lock ring 16 is only described generically herein. In this example, with reference to FIGS. 1, 2A, and 3, the lock ring 16 includes an elongate, discontinuous, circular, or ring-shaped body 50 defining a split ring structure. In other words, the body 50 has a split that creates a first end 52 and a second end 54 that can be separated or disengaged from one another when the lock ring 16 is in an opened configuration (see FIG. 3). The first and second ends 50, 52 are joined to or engaged with one another when the lock ring 16 is in a closed configuration, as shown in FIG. 1. The lock ring 16 also has a lever 56 connected to the body 50, such as near the second end 52. The lever 56 can function having an over-center quality and is used to secure the first and second ends 52, 54 of the lock ring 16 to one another so that the body 50 circumferentially shrinks to a smaller diameter and clamps onto the container 12 and lid 14, as shown in FIGS. 1 and 2A.

In the disclosed example, the body 50 of the lock ring 16 has a somewhat C-like shape when viewed in cross-section, as in FIG. 2A. The body 50 has a wall with an upper section or top leg 58 that is oriented generally horizontally in this example. The wall of the body 50 also has a lower section or bottom leg 60 that is spaced from and below the top leg 58. The bottom leg 60 is also oriented generally horizontally in this example. The wall of the body 50 also has a vertical leg 62 or wall section that extends between and connects the top and bottom legs 58, 60 to define the C-type cross-section shape of the body. The wall also includes an annular contact flange 64 extending around and protruding downward from an inner edge of the bottom leg 60. The use herein of horizontal, vertical, top, bottom, and the like means only with reference to the normal, upright, in-use orientation of the container assembly, including the lock ring 16.

As will be evident to those having ordinary skill in the art, the wall of the body 50 can be formed with a rounded cross-section having no readily discernable horizontal or vertical legs, corners, or the like. Alternatively, the legs 58, 60, and 62 can be formed so as not to be specifically or precisely straight or linear and/or so as not to be precisely or specifically vertical or horizontal, depending on the construction of a given container and lid structure. The shape in cross-section of the body 50 is configured to clamp the lid 14 onto the container 12, as discussed further below and as shown in FIG. 2A (as well as FIG. 2B).

The C-shape of the body 50 of the lock ring 16 creates a ring channel 66 that is formed by a combination of the top leg 58, the vertical leg 62, and the bottom leg 60. The ring channel 66 is concave in a radially inward facing direction. The ring channel 66 can be sized to forcibly or interferingly receive therein and snap onto the assembled combination of the lid rim and container rim including the top edge 24 and the lip 20. In one example, the top leg 58 may be slightly downturned at an inner edge. The inner edge can be angled slightly downward relative to horizontal or relative to a plane of a majority of the top leg 58. The bottom leg 60 can be slightly angled downward in a direction toward the contact flange 64 to aid in attaching the lock ring to the container 12 and lid 14, when assembled. The contact flange 64 can also be oriented at a desired angle relative to the bottom leg 60 so that the flange lies flat or flush against the side wall 22 of the container when installed.

When the lid 14 is placed over the top opening of the container 12, the container rim, including the top edge 24 and the lip 20, are positioned under and align with the channel 38 of the lid rim 32. In one example, the top edge 24 of the container rim can be formed having a curved or rounded surface, which can be similar to or mirror the shape of the channel 38. The seal 18 can be provided within the channel 38, if desired. Alternatively, the seal could be provided on the container top edge, if desired, although such a seal might hinder filling or dispensing contents from the container. As the lid 14 is lowered on the container 12, the seal 18, if any, engages the surface of the top edge 24 of the container. In one example, the seal 18 can be centered within the channel 38. When the lid 14 is pushed further onto the container 12, the seal 18 can be deformed to create a liquid tight seal between the lid and container within the channel 38.

When the lock ring 16 is not secured around the assembled lid 14 and container 12, a vertical gap may be defined between the free edge of the top leg 58 and the inner edge of the bottom leg 60. The gap can be sized to permit forced attachment to the container 12 and lid 14. When under no tension, the gap can be less than the distance between the assembled or installed combination of a lowermost free edge of the lip 20 on the container and the upper most point on the surface of the lid rim 32. To install the opened lock ring 16, the body 50 can be forced circumferentially onto the assembled lid and container rims. The gap into the ring channel 66 may be forcibly expanded, forcing the top leg 58 and bottom leg 60 further apart. The body 50 can be zipped around and/or snapped onto the assembled lid 14 and container 12 from one end to the other. This can be done until the top leg 58 of the body 50 snaps completely over the surface on the channel section 34 around the lid rim 32, the bottom leg 60 of the body seats completely under the lip 20 around the container rim, or both. The lever 56 can then be utilized to close the lock ring 16 and secure the lock ring in place, as depicted in FIG. 1 and as is known in the art.

The lever 56 and its attachment to the ring body 50 can also vary in configuration, construction, and function within the scope of the present disclosure. With reference to FIGS. 3-6, the lever 56 of the lock ring 16 is an over-center lever that is pivotally and, optionally, detachably connected to the ring body. The lever 56 can have an elongate grip section 70 at one end that can be easily grasped by a user and that can provide mechanical advantage to clamp the lock ring 16 closed. The other end of the lever 56 can be a pivot section 72 that is connectable to the ring body 50. The lever 56 in this example is generally U- or C-shaped in cross-section and has an outer vertical wall 74 that extends between and connects upper and lower walls 76, 78, respectively. Thus, when the lever 56 is closed, the lever can seat over the adjacent portion of the lock ring body 50, as needed, to be flush with the body.

Figure 3:
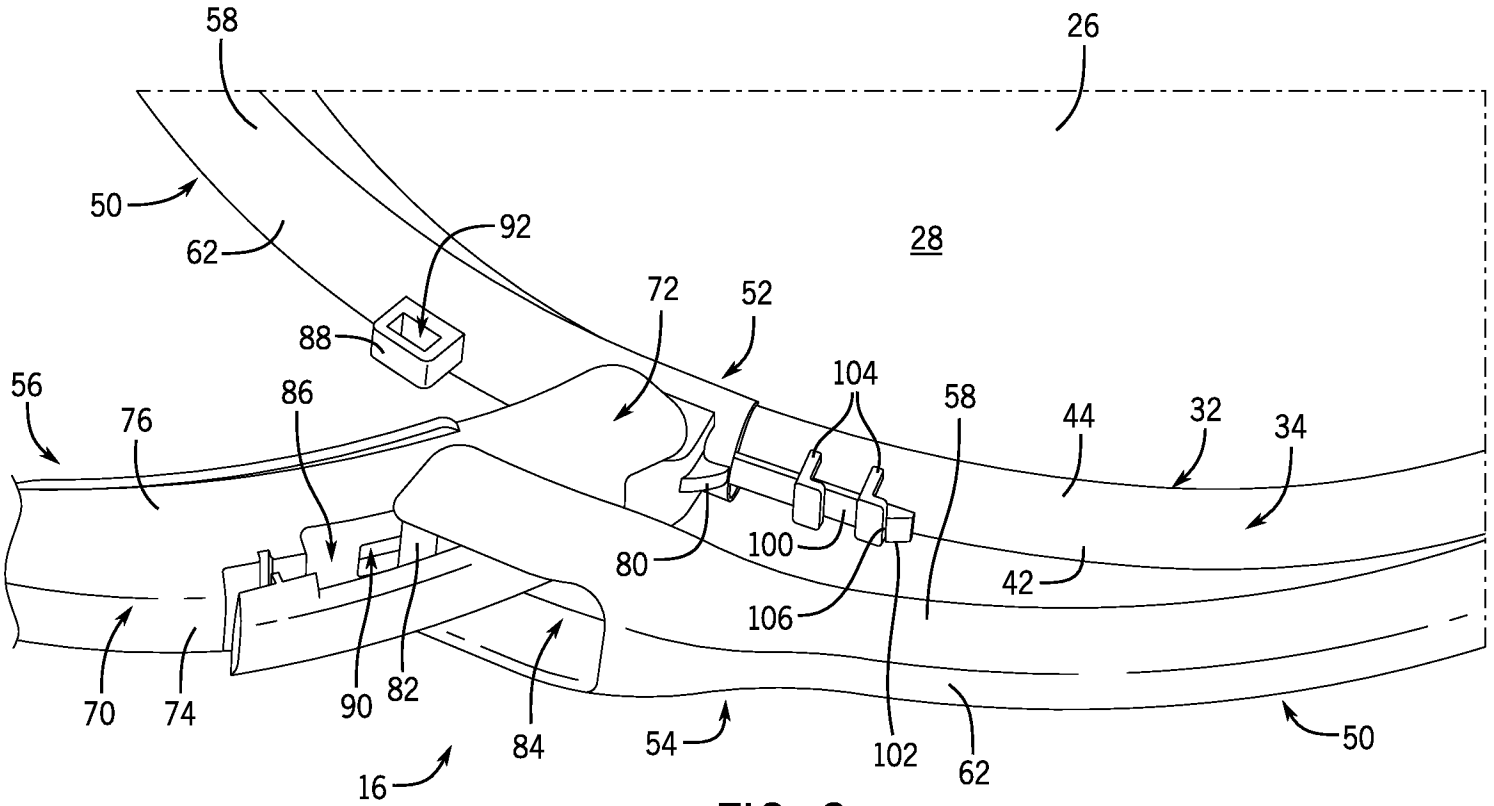
Figure 4:
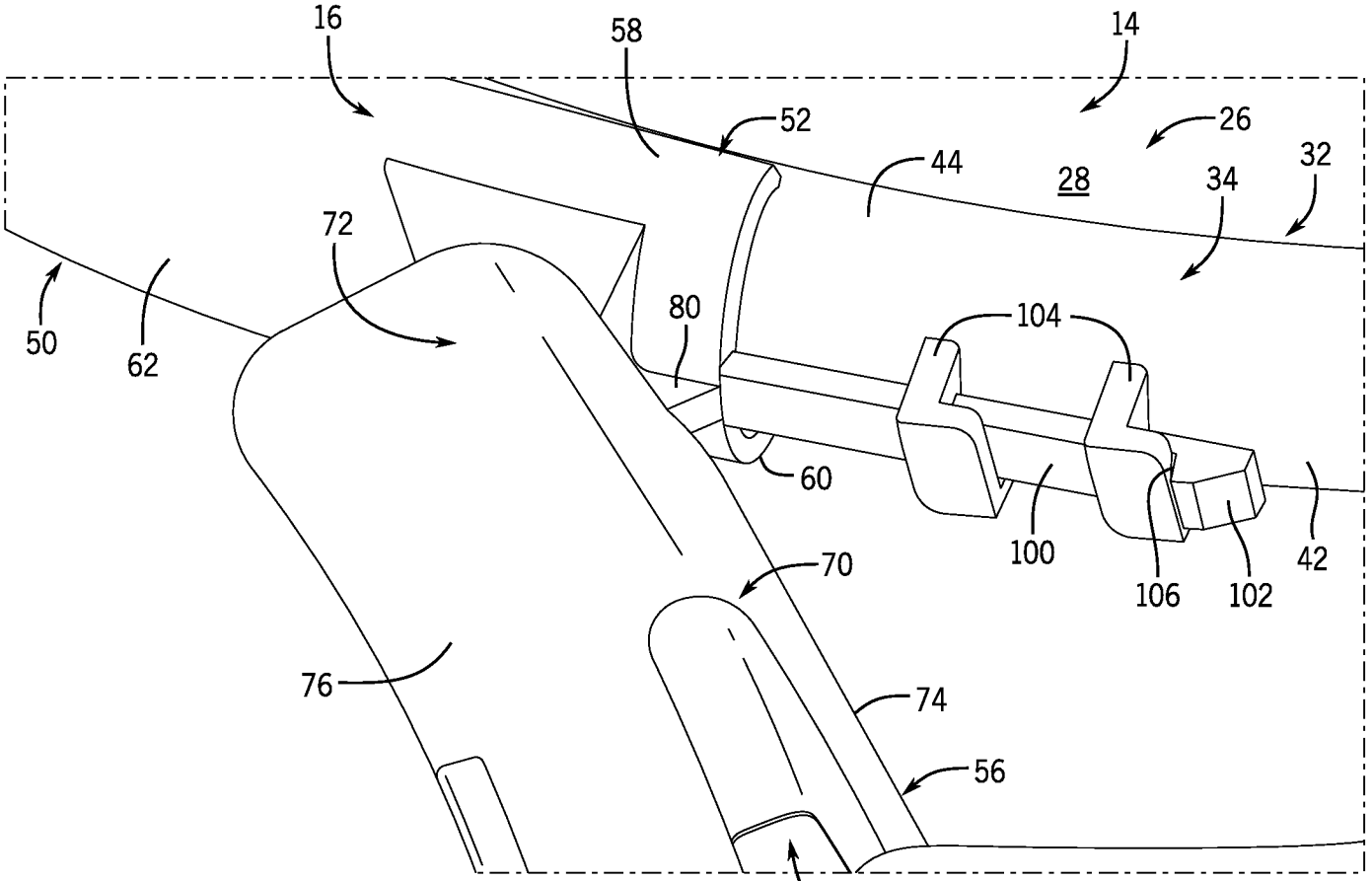
FIG. 4 shows a close-up view of the lid and lock ring combination of FIG. 3 and in a more open or unlocked condition.

The pivot section 72 of the lever 56 can vary widely in configuration and construction. A pivot pin (not shown) can be integrally formed as a part of the lever 56 or as a part of the one end of the body 50 of the lock ring 16. A hook 80 can be configured on the other of the pivot section or the lever 56 or the one end 52 of the lock ring body 50. The hook 80 can engage and pivot about the pin, such as by being snapped onto the pin. As shown in FIG. 3, the other end 54 of the lock ring body 50 can have a second pin 82 extending between the ring body legs 58 and 60 within a cut out or slot 84 in the end of the body. The lever 56 can have a slot 86 that captures the second pin 82 to connect the lever to the other end of the lock ring body 50. Pivoting the lever 56 will draw the other end 54 of the body toward the one end 52, with the second pin 82 moving over center relative to the hook 80 and pin lever connection between the lever and the body. This over center action reduces the diameter of the lock ring 16 to clamp the lock ring onto the lid and container.

A lock tab 88 can protrude from a surface of the lock ring body 50 and protrude through a hole 90 in the lever 56, when clamped or in the closed or locked condition of FIG. 1. The lock tab 88 (see FIGS. 3, 5, and 6) can have an aperture 92 through which a lock (not shown), such as a lock strap or lock tie, can be slid to lock the lever 56 in place, if desired. The lever 56 may also have a lock tab 94 with an aperture that aligns with the aperture 92 in the tab 88 on the ring body 50. The lock can be threaded through both aligned apertures for a more robust lock feature, if desired.

Figure 5:
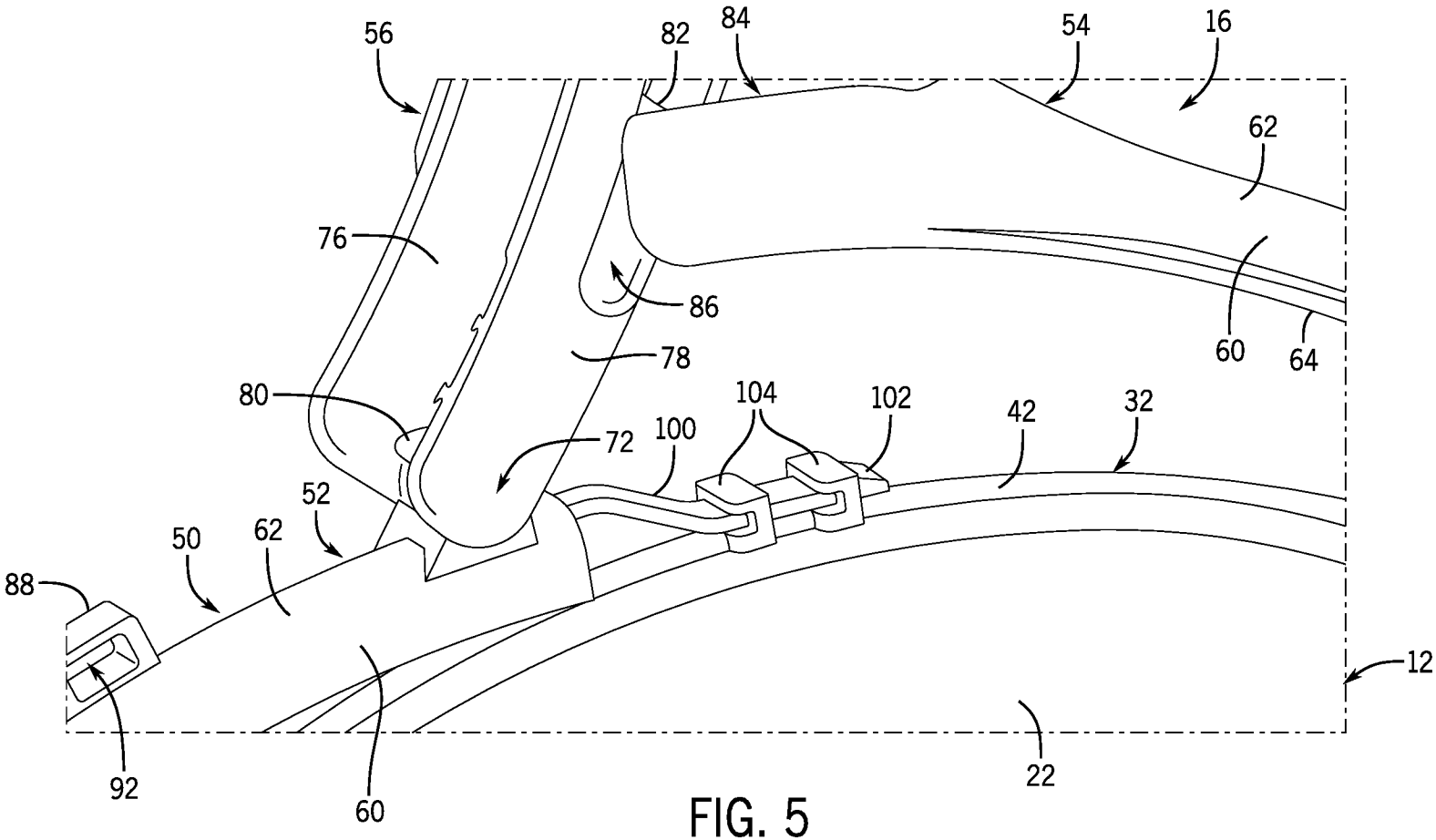
FIGS. 5 and 6 show further close-up views of the lid and lock ring combination of FIGS. 3 and 4 and show the lock ring partly separated but not detached from the lid rim.
Figure 6:
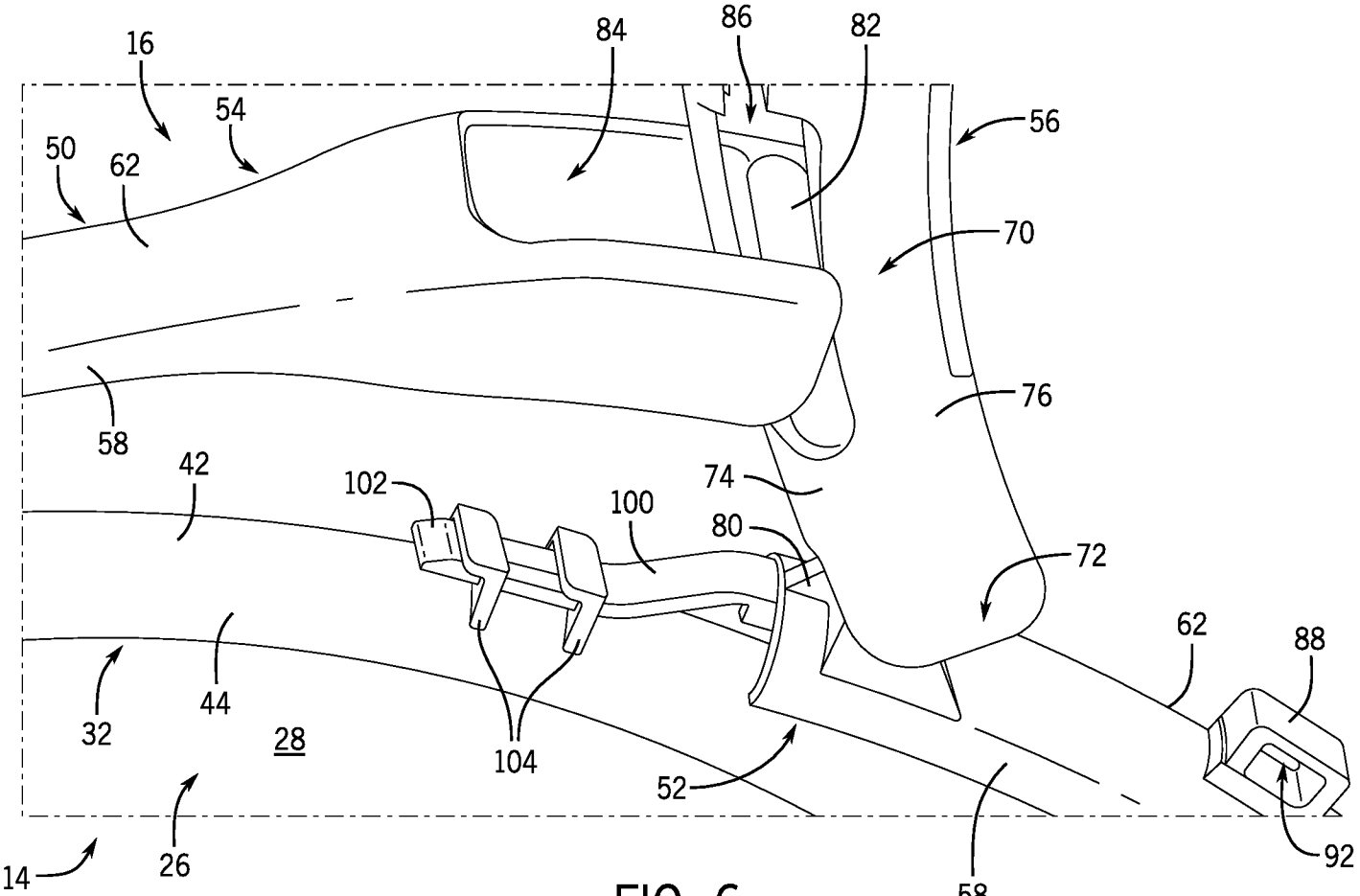

As shown in FIGS. 3, 5, and 6, the other or clamping end 54 of the ring body 50, i.e., a stepped-up segment 96, is slightly larger than the adjacent ring body on the one end 52. This stepped-up segment 96 is configured to nest over the ring body 50 of the one end 52 when the lock ring 16 is clamped or closed on the lid 14 and container 12. This stepped-up segment 96 can include the lever slot 84 and the second pin 82, as shown. When closed or clamped, the lever 56 can pivot into the slot 84 to also enable a substantially flush configuration when the lock ring 16 is clamped or closed.

According to the teachings of the present disclosure, the lid 14 and lock ring 16 are configured to form a combination by being joined to one another. In one example as shown in FIGS. 3-6, the one end 52 of the lock ring body 50 can be joined to the rim 32 of the lid 14. The one end 52 can have an integral strap 100 protruding lengthwise from the terminal end of the body 50. A prong, protrusion, or ramped element 102 is disposed at or near the end of the strap 100. The lid 14 can have one or more (a pair in this example) corresponding stand-offs 104 protruding from the rim 32. In this example, the stand-offs 104 protrude in a radially outward direction. Each stand-off 104 has aperture oriented in a circumferential direction and aligned with one another. To join the lock ring 16 to the lid 14, the strap 100 can be inserted through each of the apertures. The leading ramp shape of the prong or protrusion 102 on the strap 100 allows the strap 100 to be forced through each of the apertures. The trailing face 106 of the prong or protrusion 102 is vertical. Thus, the trailing face 106 of the ramp 102 can prevent or at least inhibit the strap 100 from being pulled back through the apertures of the stand-offs 104. Thus, once the lock ring strap 100 is inserted through the stand-off apertures, the lock ring 16 is retained as being joined to the lid 14, forming the lid and ring combination.

Thus, whether the lock ring 16 is clamped or closed or whether it is unclamped or open, the lock ring will remain connected to the lid 14. In the open or unlocked condition, the lock ring diameter is larger than that of the lid diameter. This can allow for the lock ring 16 to be fit around and then clamped onto a lid 14 and container 12, once the lid is placed over the top opening of the container.

The strap 100 can be an integral part of the lock ring body 50 or can be a separate part attached to the body. Likewise, the one or more stand-offs 104 can be separate parts attached to the lid 14 or integrally formed as a part of the lid. In other examples, different types of complementary connectors may be employed on the lock ring 16 and the lid 14 to join the two parts. Also, the connectors or connector types can be reversed on the two parts, if desired. In other words, one or more of the stand-offs may be provided on the lock ring and the strap or other such extension may be provided on the lid.

Figure 7:
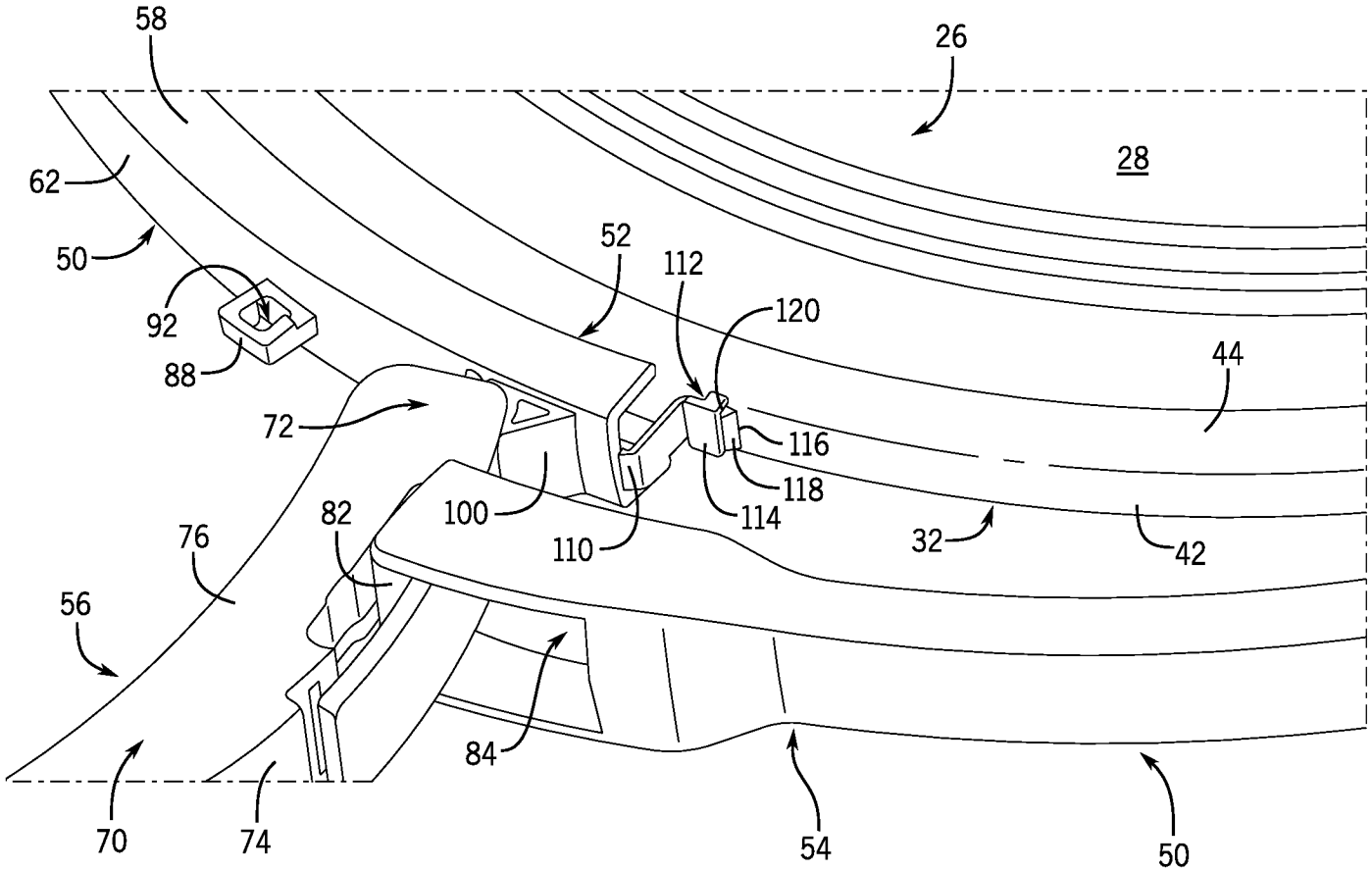
FIG. 7 shows a perspective view of another example of a lid and lock ring combination in accordance with the teachings of the present disclosure and shows the combination in a partly open or unlocked condition with the lock ring partly separated but not detached from the lid.
Figure 8:
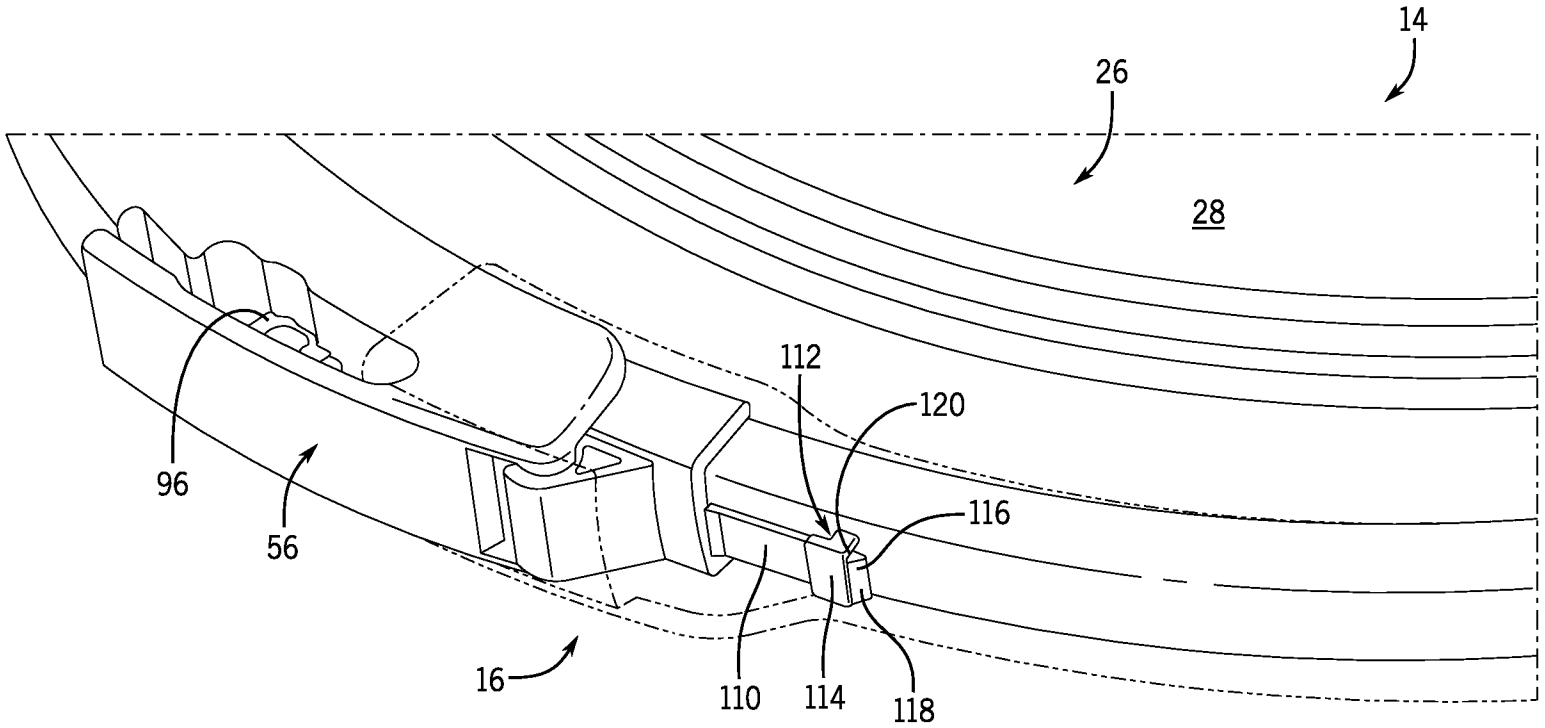
FIG. 8 shows the lid and lock ring combination of FIG. 7 is a closed or locked condition.

In another example as shown in FIGS. 7 and 8, the one end 52 of the body 50 can include a modified strap 110 to attach the one end of the ring body to the rim 32 of the lid 14. In this example, the strap 110 extends lengthwise from the distal edge of the one end 52 of the body and is a flexible strap adjacent the hook 80. The strap 110 can be threaded through a slot 112 in a single stand-off 114. Again, the strap 110 can include a prong, protrusion, or retainer 116 on a free end of the strap and the prong can have a ramped leading surface 118 and a vertical trailing or retention surface 120. The lid 14 in this example includes only the one stand-off 114 protruding radially from the lid rim 32. The slot 112 in the stand-off 114 is again sized to forcibly receive the prong 116 of the strap 110. The prong 116 will then retain the strap 110 joined to the stand-off 114. This arrangement again connects the lock ring to the lid.

FIGS. 5-7 show the lock rings in a partly open and partly separated, but not detached, condition relative to the lids. The connectors or straps, as shown, can be resiliently flexible to permit some movement of the lock ring relative to the lid while maintaining the connection between the two parts. This can aid in first installing the lid on a container, and then positioning the lock ring around the container and lid prior to clamping the lock ring onto the lid and container.

Alternatively, it is possible that the other end, i.e., the stepped-up segment in the first example, can be configured to be attached to the rim of the lid to create the combination. Other examples are also possible, as long as the lid and lock ring can be joined to one another to form a combination of the two parts.

FIGS. 7 and 8 also better illustrate earlier described aspects of the lock ring and lever, such as the hook and pin pivot connection of the lever and lock ring, and the nested nature of the various parts in the closed condition. In these examples, a part of the lock ring body or the lever can cover the joint or connecting parts between the lid and lock ring. This can hide their appearance and provide some protection from contact or tampering damage.

Although certain lid and lock ring combinations for containers have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A container lid and lock ring combination comprising:

a lid for a container;

a lock ring configured to extend loosely around the lid, the lock ring also configured to be tightened for securing the lid to a container; and a joint connecting the lid and the lock ring to one another, wherein the joint includes a strap on one of the lid and the lock ring and includes a stand-off on the other of the lid and the lock ring, a free end of the strap configured to be received through an aperture of the stand-off, wherein the strap is on one end of a lever coupled to one end of the lock ring body, and wherein the strap is received through a slot in the one end of the lock ring body and then through the aperture of the stand-off.

2. The container lid and lock ring combination of claim 1, wherein the lid is formed of a plastic material.

3. The container lid and lock ring combination of claim 1, wherein a body of the lock ring is formed of a plastic material.

4. The container lid and lock ring combination of claim 1, wherein a prong is provided on the free end of the strap, the prong configured to be forcibly received one way through the aperture but to prevent or inhibit being reversed the other way through the aperture.

5. The container lid and lock ring combination of claim 1, wherein the strap is on one end of the lock ring body, and wherein the stand-off is on a rim of the lid.

6. The container lid and lock ring combination of claim 5, wherein the strap is formed integrally as a part of the lock ring body.

7. The container lid and lock ring combination of claim 1, wherein the stand-off is formed integrally as a part of the lid rim.

8. A container assembly comprising:

a container having a top opening;

a lid for closing off the top opening of the container;

a lock ring configured to extend loosely around the lid in an open or unlocked condition and to be tightened for securing the lid to a container; and a joint connecting the lid and the lock ring to one another to form a lid and lock ring combination, wherein the joint includes a strap on one of the lid and the lock ring and includes a stand-off on the other of the lid and the lock ring, a free end of the strap configured to be received through an aperture of the stand-off, wherein the strap is on one end of a lever coupled to one end of the lock ring body, and wherein the strap is received through a slot in the one end of the lock ring body and then through the aperture of the stand-off.

9. The container assembly of claim 8, wherein the lid is formed of a plastic material.

10. The container assembly of claim 8, wherein a body of the lock ring is formed of a plastic material.

11. The container assembly of claim 8, wherein a prong is provided on the free end of the strap, the prong configured to be forcibly received one way through the aperture but to prevent or inhibit being reversed the other way through the aperture.

12. The container assembly of claim 8, wherein the strap is on one end of the lock ring body, and wherein the stand-off is on a rim of the lid.

13. The container assembly of claim 12, wherein the strap is formed integrally as a part of the lock ring body.

14. The container assembly of claim 8, wherein the stand-off is formed integrally as a part of the lid rim.

* * * * *